United States Patent [19]

Or

[11] 4,357,115

[45] Nov. 2, 1982

[54] PRINTING SYSTEM FOR MULTIPLE CHARACTER LANGUAGES AND ELEMENTS THEREOF

[76] Inventor: Michael C. P. Or, 619 Linden Ave. #5, South San Francisco, Calif. 94080

[21] Appl. No.: 195,696

[22] Filed: Oct. 9, 1980

Related U.S. Application Data

[63] Continuation-in-part of Ser. No. 408, Jan. 2, 1979, abandoned.

[51] Int. Cl.[3] ..... B41J 1/30

[52] U.S. Cl. ..... 400/110; 101/93.18; 400/144.2

[58] Field of Search ..... 400/109, 110, 144.1–144.4, 400/149–151.1; 101/93.11, 93.17–93.19

[56] References Cited

U.S. PATENT DOCUMENTS

| | | | |
|---|---|---|---|
| 3,809,203 | 5/1974 | Ogawa et al. | 400/110 |
| 3,809,204 | 5/1974 | Ogawa | 400/110 |
| 3,820,644 | 6/1974 | Yeh | 400/110 |
| 4,026,403 | 5/1977 | Inose et al. | 400/110 X |
| 4,049,110 | 9/1977 | Frechette | 400/144.2 X |
| 4,064,983 | 12/1977 | Inose et al. | 400/110 |
| 4,069,907 | 1/1978 | Isobe et al. | 400/144.2 |
| 4,079,482 | 3/1978 | Yeh | 400/110 |
| 4,197,022 | 4/1980 | Dollenmayer | 400/149 X |

OTHER PUBLICATIONS

"Chinese Language Becomes a Bit Faster" by C. Moss, *New Scientist,* Feb. 16, 1978, pp. 418–420.

*Primary Examiner*—Paul T. Sewell

*Attorney, Agent, or Firm*—Townsend and Townsend

[57] ABSTRACT

The invention disclosed is a printing system particularly useful for printing languages having large number of characters such as Chinese. The printing system in one aspect comprises a packet of coaxially disposed printing elements, each having a generally flat edge, an axis of rotation proximate that edge, and at least one series of character faces disposed circumferentially relative to the axis of rotation. The printing elements are generally mutually aligned so that their flat edges are disposed adjacent to a print receiving means such as a platen and are axially translatable so that any selected printing element can be placed in a pre-print position. Each printing element is rotatable so that a selected character face on the printing element in pre-print position can be juxtaposed into a print position relative to the print receiving means for printing of the character.

46 Claims, 8 Drawing Figures

PRINTING SYSTEM FOR MULTIPLE CHARACTER LANGUAGES AND ELEMENTS THEREOF

This application is a continuation-in-part application of a previously filed application of the same title, Ser. No. 408, filed Jan. 2, 1979, now abandoned.

BACKGROUND OF THE INVENTION

1. Field of the Invention

This invention relates to printing systems particularly suited for printing multiple character languages such as Chinese and Japanese Kanji.

2. Summary of the Prior Art

Conventional printing systems such as typewriters and other word processing systems are usually designed for printing languages such as English that have a relatively small number of alphabetic characters which are combined to form words. Due to the large number of characters necessary to print multiple character languages such as Chinese, the keyboards and/or printing elements of these conventional systems are generally inadequate for printing languages in which one character represents one word. Chinese, for example, requires the use of at least about 2,500 characters, and up to about 10,000 characters if less frequent words and historic character forms are needed, while Japanese Kanji requires about 2,500 characters to print the language.

Consequently, the commonly used current Chinese typewriter is a device having individual lead character faces laid out in a flat bed matrix. The appropriate character face to be printed is visually located by the operator who then activates a stylus which mechanically lifts the character face for printing. When uncommon characters are required, they must be individually selected from a separate tray and placed in the bed for use. As a result, the character printing process is a time-consuming operation with character-printing speeds of about 10 or more characters per minute. Additionally, considerable time is required to train the operator to easily select the appropriate characters from the bed.

Various alternate printing systems have been developed to overcome some of the problems associated with the use of the traditional Chinese typewriter, and to develop word processing systems capable of encoding and storing as well as printing the characters. Some such systems have incorporated a separate visual character matrix in order to aid the operator in selecting the appropriate character. Other systems have utilized the above flat bed matrix system to create a word processing system capable of encoding and printing Chinese by generating and storing the X and Y coordinates of the desired characters in the matrix and using an automatic printer to print the encoded characters. Such a system is described in U.S. Pat. No. 4,064,983.

Some similar systems have been developed in which the character grid is wrapped around a rotating drum rather than laid out on a flat bed matrix. The drum is rotated for visual location of the desired characters by means of a cursor, and a switch is activated to encode the character coordinates. The above alternate systems frequently still present problems, however, in view of the difficulties associated with printing the characters at high speeds with high quality print. Additionally, complicated control mechanisms are frequently necessary, and inexpensive construction of the systems can be difficult.

A keyboard system has been developed for use in connection with a Chinese character teleprinter which utilizes a standard western keyboard for encoding characters and storing the codes with only two to three keyboard strokes per character. It is described in U.S. Pat. No. 3,809,204, and is disclosed in association with a visual character board displaying the characters in relation to the keys. The characters are coded by means of a 6 or 7 element code unit, two code units being used to describe each character. Each key on the keyboard can be used to independently produce a 6-element code unit, and the "shift keys" can be used when 7-element code units are to be used. As a result, only two keys need be depressed for production of a character when a 6-element code unit is used, and a maximum of three or four keystrokes are used when coding characters using 7-element code units. However, this keyboard system as disclosed is adapted for encoding and storing encoded characters and is not combined with a printing head for direct printing of the characters.

Additional Chinese typewriters more like standard western typewriters have been developed which divide the characters into zones. An individual character is built up by keyboard composition of its various zones before printing. However, this method frequently requires the operator to use an average of about 9 key strokes to print each character, and problems with the print head still exist.

Furthermore, a printer has been developed and is described in U.S. Pat. No. 4,026,403, which utilizes a group of circular print wheels with spokes extending from a central hub and a series of character faces circumferentially disposed at the periphery of the spokes. At given signals, the carriage which stores the print wheels below the platen revolves to place any selected print wheel in a pre-selected position from which the wheel is upwardly pivoted to a print position adjacent the platen. Subsequently, the print wheel is rotated for printing the selected peripheral character.

However, this printer, even when designed for use in printing only 2,000 to 2,500 characters, usually requires three mechanical steps to print a given character: rotation of the carriage, displacement of a print wheel over a distance in excess of the diameter of the wheel into print position, and rotation of the print wheel itself. Additionally, this printer requires a rather large number of print wheels, about 130 to over 200, to print about 10,000 characters if the wheels contain about 46 to 75 each as suggested, and the printer as disclosed has not been adapted for use with a specialized keyboarding system.

SUMMARY OF THE INVENTION

The present invention in one aspect is a printing system which minimizes many problems associated with the use of prior printing units for printing Chinese or other multiple-character languages. The printing system in one aspect comprises a packet of printing elements each having a generally flat edge, an axes of rotation proximate the flat edge, and at least one series of character faces disposed circumferentially in relation to the axis of rotation. The printing elements are generally coaxially disposed and mutually aligned so that their flat edges are generally disposed adjacent to a print receiving means such as a platen and are axially translatable so that any selected printing element can be placed in a position for printing (the "pre-print position"). Each printing element is rotatable so that a selected character face on the printing element in a pre-print position can be juxtaposed into a print position for printing of the character. Also included are means for translating and rotating the printing elements as well as a set of input elements in certain embodiments, so that actuation of input elements can cause translational and rotational movement of the printing elements.

Preferably, the printing elements of the present system are semi-circular in form with their diametric edges generally disposed adjacent the print receiving means. In such cases, they are preferably in the form of a hub with spokes extending therefrom wherein the character faces for printing are circumferentially disposed on the spokes. Although the printing element can contain only one series of circumferentially disposed character faces it frequently includes more than one radially spaced series of circumferentially disposed character faces. When such is the case, the most commonly used characters are preferably located in the same series on all of the printing elements, while less common words and/or character forms are located in other series. Also when the printing elements include more than one series of circumferentially disposed characters, the system includes means for radially displacing a selected printing element so that characters in different series on a printing element can be put into position for printing.

In some aspects of the invention, the input elements of the printing system are in the form of a standard western keyboard. In this aspect, the printing elements can be of largely any form having character faces circumferentially disposed relative to an axis of rotation. Preferably, the printing elements are as described above, and each character key of the keyboard independently actuates translational movement of the printing elements as well as rotational movement of the printing element in pre-print position. Consequently, the printing element containing the desired character can be moved into pre-print position by depression of one character key and the individual character face rotated into print position by depression of a subsequently selected character key. If the printing elements include more than one series of circumferentially aligned character faces, radial displacement of the printing element is preferably separately actuated by depression of a shift key before actuation of the character keys so as to place characters in different series in position for printing.

For ease in selecting characters and for rapid operator-training, the keyboard in some embodiments is interconnected with a visual character array which aids the operator in selecting the keys for the character. The character array displays the characters in a grid, each longitudinal row usually containing the characters found in one series on one printing element and indicating the key to be depressed to translate that particular printing element into a pre-print position. Each character is horizontally aligned with an indication of the key to be depressed to actuate rotation of the printing element to place that particular character in print position. A separate matrix is usually provided for character series located in different radially spaced series on the printing elements.

Thus, in utilizing the entire system in one of its preferred embodiments, the operator depresses the key which translates the appropriate printing element into pre-print position. This is very quickly done once the operator is familiar with the system especially when the characters on each printing element are associated by meaning and/or form; in any case, the character can be quickly located on a character grid and the appropriate key then selected. The operator then depresses a second character key (or the first character key for a second time) which produces rotation of the printing element to place the desired character in print position, the printing element so rotates and the character face is impacted onto the print receiving means for printing. If the printing elements contains more than one radially spaced character series, the operator utilizes a shift key to adjust the distance between the axis of the printing elements and the print receiving means before actuating the character keys to place the desired character series in position for printing.

This particular system provides numerous advantages in printing Chinese or other multiple character languages. It can be provided in a small and compact unit which can easily and relatively quickly print up to 10,000 Chinese characters or more. Usually only two keystrokes and two mechanical movements of the printing elements are required to print one character, use of a shift key and slight radial displacement of the printing elements being necessary if the character is on a different series on a printing element having multiple series of characters. Selection of the appropriate keys is easy and rapid, once the operator is familiar with the system, particularly where the characters are arranged by form and/or meaning on the printing elements, and especially when a visual character array is also provided.

BRIEF DESCRIPTION OF THE DRAWINGS

FIG. 3A illustrates the printing elements in an initial position relative to a platen and print hammer and also shows a mechanism for radially displacing a selected printing element by adjusting the distance between the axis of the printing elements and the platen.

FIG. 3B illustrates adjustment of the distance between the axis of the printing elements and the print receiving means so that a character in the outermost series of characters on the printing element is in print position.

FIG. 3C illustrates the printing element packet translatably moved so as to place a selected printing element in pre-print position.

FIG. 3D illustrates rotation of the selected printing element in pre-print position into position for printing a selected character of an inner character series.

FIG. 3E illustrates printing of the selected character in print position upon impact by a print hammer.

DESCRIPTION OF THE SPECIFIC EMBODIMENTS

Figure 1:
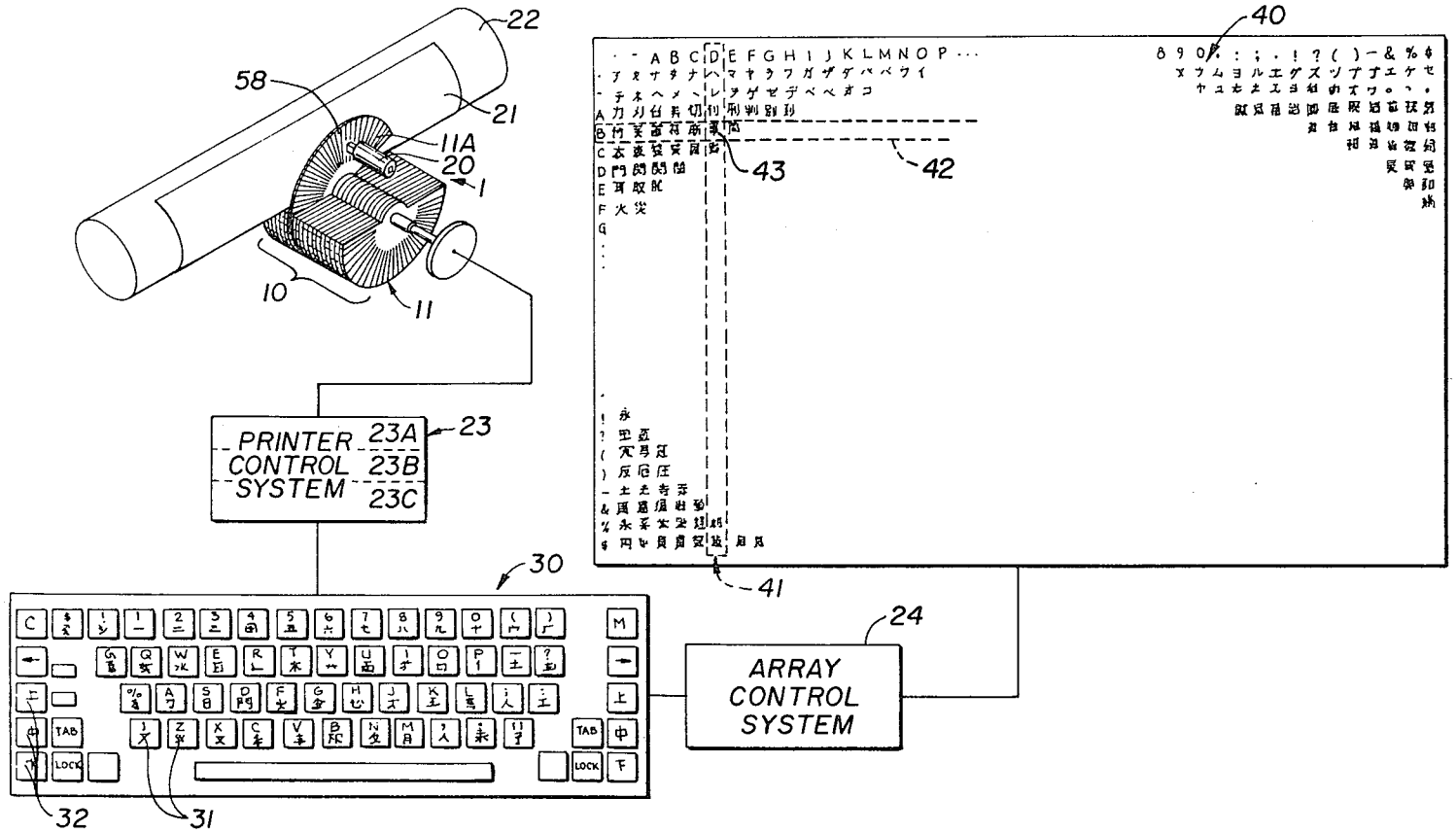
FIG. 1 is a schematic diagram of a preferred embodiment of the printing system of the present invention particularly illustrating a keyboard, a packet of printing elements and a character array.

The present invention in one aspect is a printing system for printing Chinese or other multiple character languages. Referring to FIG. 1, a schematic diagram of a preferred embodiment of the printing system is illustrated. The system in this embodiment includes a printer 1 composed of a packet 10 of coaxially disposed generally planar printing elements 11 mutually aligned so that their diametric edges are generally adjacent a print receiving means such as platen 22.

The printing elements 10 are axially translatable in unison in the preferred embodiment of the present invention. Such axial displacement places one of the printing elements, i.e. 11A in FIG. 1, in a "pre-print" position in which it is in the proper axial location for printing. With the selected element in the pre-print position it is rotated about its axis, as is element 11A in FIG. 1, to place the appropriate spoke 58 of the printing element in position in printing. Once this two step operation has taken place, i.e., axial translation of the packet 10 to select the appropriate printing element, and rotation of that particular element to select the proper spoke, the print hammer 20 impacts the printing element to print a selected character face on paper 21. As illustrated in more detail hereinafter, where the spokes of the printing elements 11 have radially spaced sets of character spaces, an initial shift in the location of the axis of the printing elements is performed before the translation and rotation steps, much as in a standard typewriter where shifting is used to select between capital and small leters. The printer is controlled by a printer control system 23 which provides the interface with a western keyboard 30. Keyboard 30 contains a number of character keys 31, shift keys 32, plus standard keys such as back space, a tubulator and the like. In the preferred embodiment there are three shift keys 32 as shown and 50 character keys. As described in more detail hereinafter, the position of the axis of the packet 10 of printing elements is controlled by the shift keys 32, and the axial translation of the packet and rotation of the selected element are controlled by respective successive actuations of character keys 31. The electromechanical interface between keyboard 30 and printer 1 is provided by printer control system 23 which uses conventional logic and electromechanical equipment to perform the desired functions and is illustrated only schematically in FIG. 1.

The keyboard 30 is shown interfaced with a character array 40 by means of an array control system 24 illustrated schematically and functionally described in more detail hereinafter. Array 40 displays the character in a two dimensional grid, in which both the rows in columns are indexed by the different character keys 31, including the letters of the alphabet and punctuation symbols. Each character to be printed is thus indexed by a pair of character keys 31. For example, a given Chinese character 43 is located in column 41 and row 42, designated as Column D and Row B in FIG. 1. A 1:1 correspondence thus exists between each character to be printed such as 43 and an ordered pair of character keys 31 such as B (row 42), D (column 41).

Figure 2A:
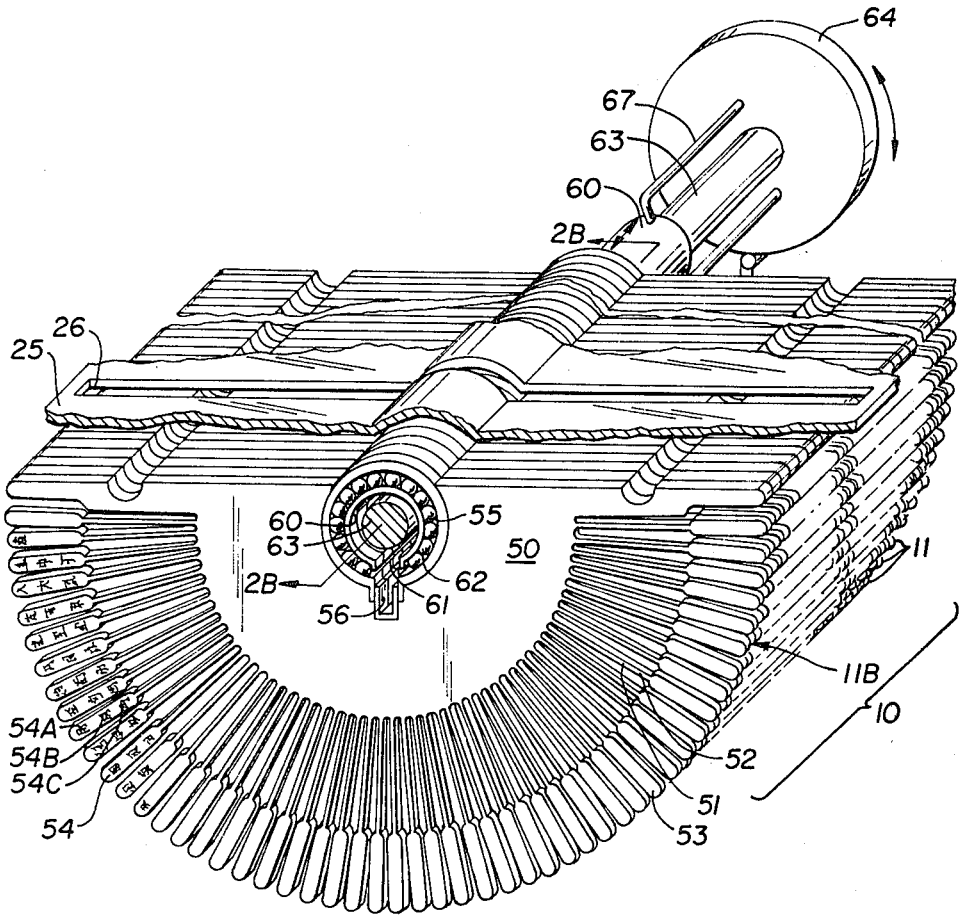
FIG. 2A is a perspective view of part of an embodiment of the printing system of the present invention and particularly illustrates a preferred printing element of the present invention and part of a mechanism for translational and rotational movement of the printing elements.

Referring now to FIG. 2A, the preferred printing element of the present invention can be seen. The printing element, 11B, is semi-circular in form with a plurality of spokes 51 extending from a hub 50, each spoke having a stem 52 and a print face 53. The hub is provided with a circular aperture 55 having an elongate extension 56.

Character faces 54 are circumferentially disposed on the surface of the print faces. The character faces are aligned in separate radially spaced series, here three series, 54A, 54B and 54C. Each series is composed of characters circumferentially disposed at a substantially constant radial distance from the rotational axis, generally located at 63, of the printing element. The character faces are preferably aligned on the printing element so that characters having related meanings are found on one printing element with the most commonly used characters located in the same series, i.e., series 54B, on the printing elements. Unusual characters or historic forms are preferably located in the other series, i.e., 54A and 54C. The printing elements preferably each contain 50 spokes and 50 character faces in each series so that one character face of a series is found on each spoke. For printing Chinese, the printing element preferably contains three or four series of character faces circumferentially disposed at different radial positions.

As a result, each preferred printing element is capable of printing 50 characters if it contains only one series of characters faces, and 150 to 200 characters if it contains 3 or 4 series of characters faces respectively. When the entire packet contains 50 such printing elements it is capable of printing 2,500, 7,500 or 10,000 individual characters when the printing elements contain one, three or four series of character faces, respectively. Consequently, when the printing system is to be used for printing Japanese Kanji, a 50-printing element packet of 50-spoke printing elements need only have one series of character faces on the printing elements for printing of 2,500 characters, while Chinese may require three or four series of character faces per printing element to print 7,500 to 10,000 characters.

The dimensions of a printing element having three series of character faces as shown are preferably as follows: radius, about 70 millimeters; circumference, about 220 millimeters; spoke length, about 30 millimeters; print face length, about 14 millimeters; print face width, about 3 millimeters; spoke thickness, about 1.5 millimeters; character face depth, about 1 millimeter; and disk aperture diameter, about 10 millimeters.

As illustrated in FIGS. 2A and B, the printing elements are suspended on a cylinder 60 extending through apertures 55. Cylinder 60 is provided with an elongate aperture 61 in the cylinder wall extending the entire length of the cylinder. Bearings 62 are usually provided between the printing elements 11 and cylinder 60 to facilitate rotation of cylinder 60 relative to the printing elements while prohibiting axial movement of the elements relative to the cylinder.

Rod 63 is located within cylinder 60 and cylinder 60 is movable axially relative to the rod. The packet 10 of printing elements 11 is attached to cylinder 60 by bearings 62 so that the entire packet translates axially with cylinder 60. Movement of cylinder 60 and the packet 10 of printing elements 11 mounted thereto is controlled by conventional servomechanical techniques employing an output shaft such as 67.

Figure 2B:
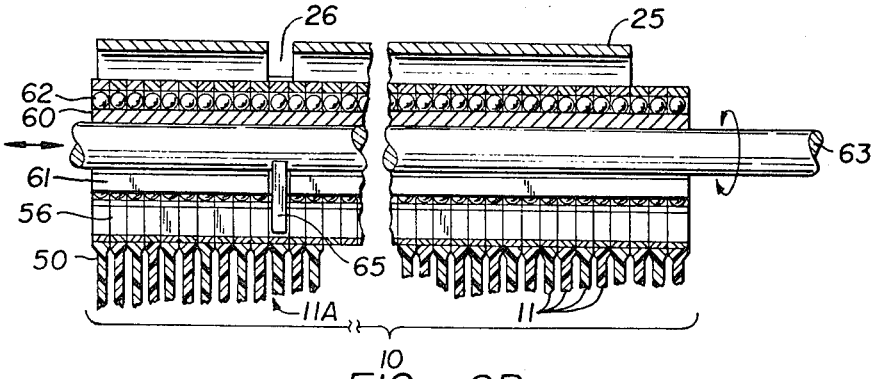
FIG. 2B is a cross-section of an embodiment of the printing elements of the present invention taken at lines 2B—2B of FIG. 2A and illustrates a specific mechanism which allows for translational and rotational movement of the printing elements.

A cover 25 overlies the packet 10 of printing elements 11. Cover 25 has an aperture 26 having a width which is sufficient to allow the rotation of a single printing element 11 about its axis, while preventing the rotation of any other printing element. Axial movement of cylinder 60 controlled by output 67 positions a selected printing element such as 11A so that it immediately underlies slot 26 as illustrated in FIG. 2B. Printing element 11A has thus been axially translated to a "pre-print position" where it can be utilized for printing.

Rod 63 is provided with a key 65 extending downwardly in the plane of slot 26 occupied by printing element 11A in its pre-print position. When the packet 10 of printing elements 11 have been axially translated so that selected element 11A is in its pre-print position, rod 63 and key 65 is rotated. Key 65 engages the elongate aperture 61 in the wall of cylinder 60 and the elongate aperture 56 of printing element 11A so that both the cylinder and printing element 11A rotate with shaft 63. The remaining printing elements 11 are prevented from rotating by cover 25, and bearings 62 allow cylinder 60 to rotated with respect to these other printing elements. Rod 63 is rotated a selected amount to place the appropriate spoke 51 in the desired radial position for printing utilizing a character face 54 located thereon.

Figure 3A:
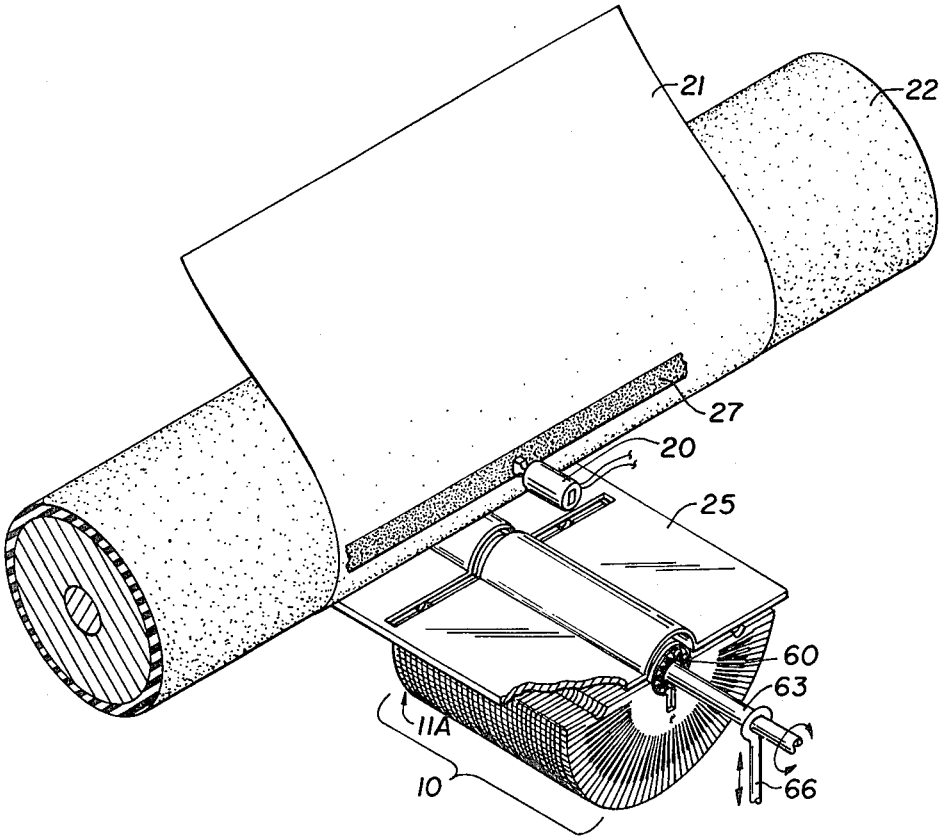
FIGS. 3A through 3E are perspective views of an embodiment of the printing system of the present invention which particularly illustrate movement of the printing elements to print a selected character.
Figure 3B:
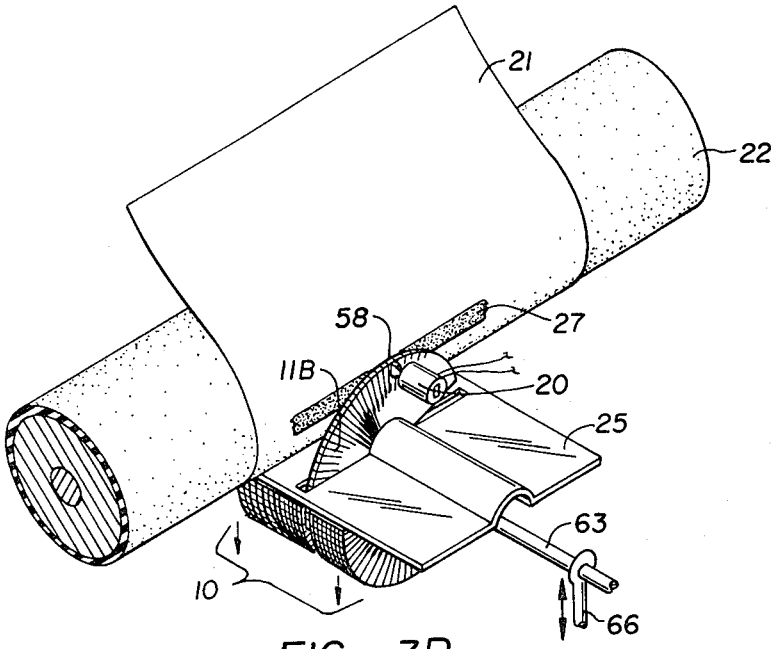
Figure 3E:
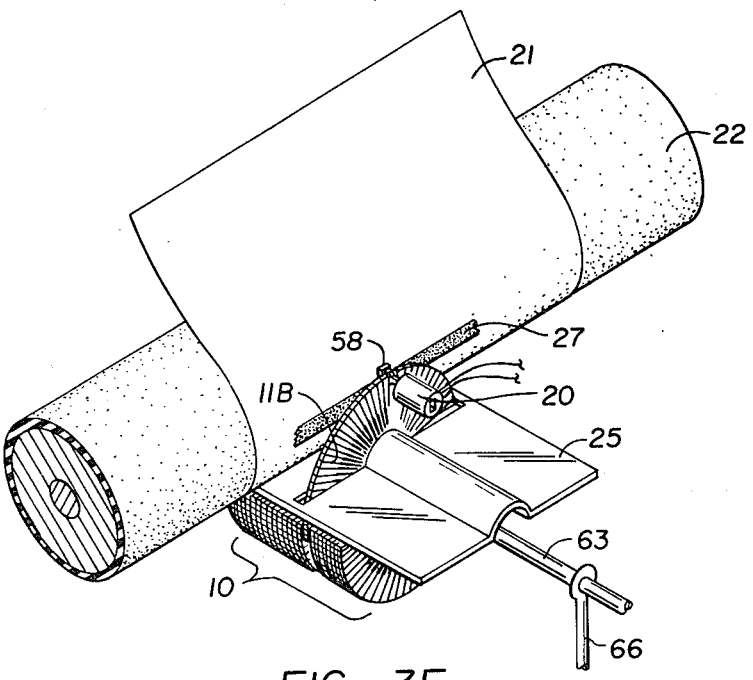

FIGS. 3A through 3E illustrate such placement of a selected character in print position and the printing of the character. In FIG. 3A the packet 10 of printing elements is shown aligned so that the diametric edges of the printing elements are largely below and adjacent to platen 22 supporting paper 21. Print hammer 20 is located in front of platen 22 at the character printing position and an inked ribbon or the like 27 is located between the paper 21 and print hammer 20. A mechanism 66, usually one of a pair, is shown which can radially displace the printing elements by adjusting the distance between the rotational axis of the printing elements and the axis of the platen 22.

Where radially spaced character sets are provided on the spokes of pending elements 11, the initial step of printing a character is the actuation of the appropriate shift key 32 (see FIG. 1). Shift key 32 operates through portion 23A of printer control system 23 to adjust the height of the packet 10 of printing elements using support 66. As illustrated in FIG. 3B, the entire packet 10 is raised or lowered depending on the shift key selected. Generally speaking, the most common characters are located at a common shift position so that actuation of the various shift keys 32 and shifting of the packet 10 is held to a minimum.

Figure 3C:
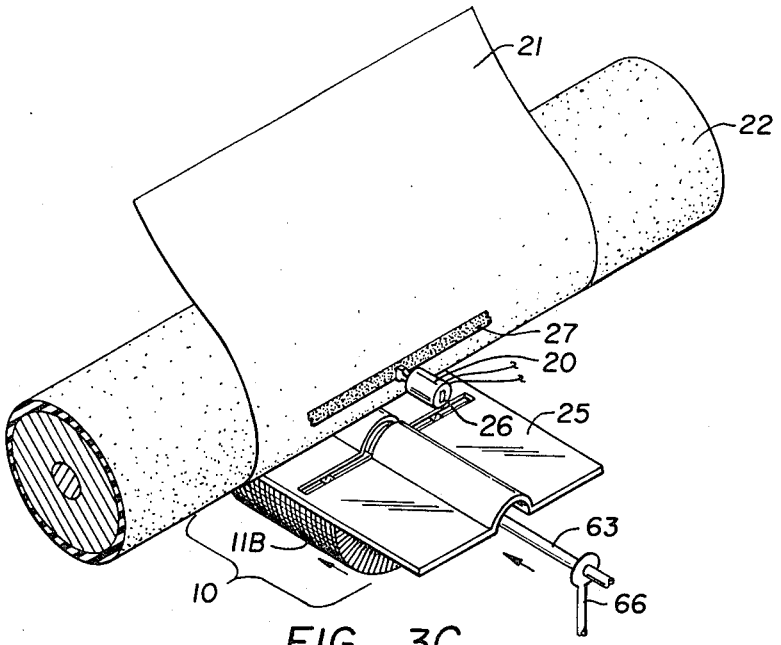

After the appropriate shift key 32 has been actuated, the packet 10 of printing elements is axially translated to place the selected printing element in its pre-print position, e.g., element 11B in FIG. 3C. Printing element 11B is selected by actuating the character key 31 corresponding to that element, and standard servomechanical techniques are utilized by portion 23B of printer control system 23 to control output 67 and translate the packet of printing elements on cylinder 60 until element 11B is in its pre-print position underlying slot 26.

Figure 3D:
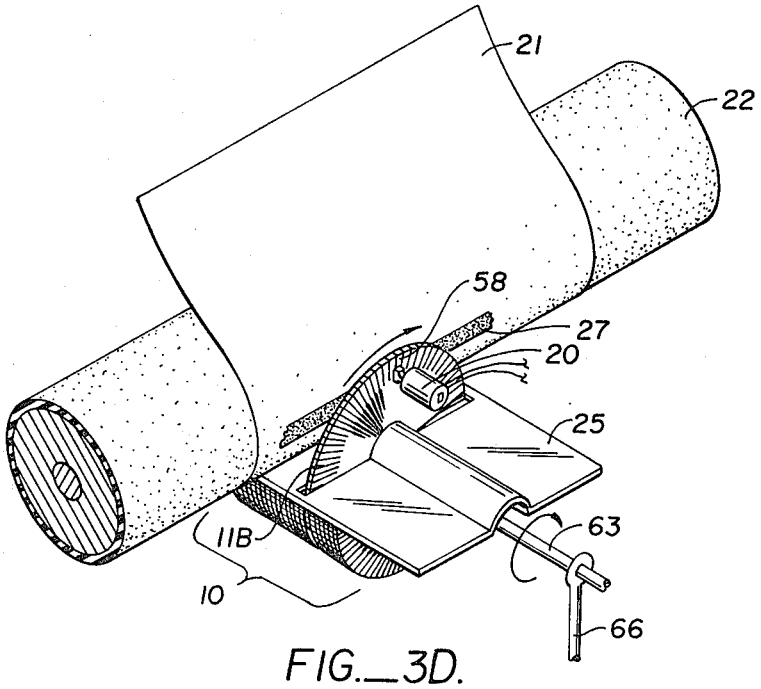

The next actuation of a character key 31 operates through portion 23C of printer control system 23 using conventional servomechanical techniques to rotate shaft 63 (FIG. 3D). Key 65 engages printing element 11B and rotates it so that the desired spoke 58 is aligned with the portion of the paper in position for printing.

Next, hammer 20 is actuated (FIG. 3E) to drive spoke 58 toward the paper so as to press typewriter ribbon 27 against the paper to impress an image of the character face on spoke 58 on the paper. Subsequent characters are printed by actuating the shift key 42 if necessary, and striking successive pairs of character keys 31, each pair of keys resulting in the printing of a single character.

Thus, it can be seen that at most three keys need be depressed to print any given character using the present printing system, a shift key for adjusting the distance between the axis of the printing elements 11 and the platen 22, one character key for translational movement of the printing elements, and another character key (or the same key twice) for rotation of the printing element to its print position. If Japanese Kanji is to be printed and only 2,500 characters are needed, only two character keys (or one key twice) need be depressed because the printing elements need contain only one series of character faces so that radial displacement of the printing elements 11 is unnecessary. When Chinese is to be printed, depression of the shift key will also be unnecessary if the character face to be printed is in a series requiring no change in the position of the printing element. When the most commonly used Chinese characters are located in one series, e.g., 54B, depression of a different shift key is rarely necessary for everyday use.

The system is preferably utilized in conjunction with a visual character matrix 40 as shown in FIG. 1, a separate character matrix preferably being provided for the characters in each of series 54A, 54B and 54C on the printing elements. The matrix displays the characters in rows, each longitudinal row, i.e., 42, containing the characters on a given printing element aligned with an indication of the character key which actuates translation of the printing element to pre-print position. The horizontal rows contain the characters requiring a given degree of rotation of the printing elements aligned with an indication of the key which actuates such rotation.

The character matrix is most preferably printed on a translucent board placed in front of a lighting system. The lighting system is interconnected with the keyboard 30 by means of an array control system 24. Depression of a character key 31 which actuates translational movement of the printing element packet 10 to place a selected printing element in pre-print position also switches on a portion of the lighting system so as to light up the longitudinal row of characters, i.e., 42, contained on the selected printing element to aid in character and key selection.

The matrix aids the operator in selecting the shift key 32 and the character key 31 to be depressed to place the proper printing element and series of character faces in position for printing, and is particularly useful in initially training the operator to locate these keys. If the characters are aligned on the printing elements so that characters of similar meaning are largely found on one printing element, and the most commonly used characters are usually on the same series, i.e., 54B, of all the printing elements, an operator familiar with the system will rarely need to consult the matrix to select these keys.

Once these keys have been selected and depressed, the appropriate longitudinal row of the character matrix corresponding to the characters of the selected printing element lights for easier character selection. The desired character is then visually located on the lit longitudinal row, and the key shown horizontally aligned with the character is depressed for rotation of the printing element. The character face is then printed, and the selected printing element rotates back to resting to position for selection of the next character for printing.

Thus it can be seen that the printing system of the present invention provides a very rapid means of printing multiple character languages such as Japanese Kanji and Chinese. The printing elements are so provided that the amount of mechanical movement necessary to print large numbers of characters is minimized. Only two to three keystrokes and two to three corresponding movements of the printing elements are required to print a character. When a character array is included, location of the keys to be depressed for a given character is easy and convenient and operator training time is reduced. Additionally, the system can be designed in a small and compact unit similar in size to a western typewriter.

It is to be understood that the foregoing description is intended by way of illustration and not by way of limitation, and that many variations can be made within the scope of the invention which is described by the appended claims.

What is claimed is:

1. A printing system comprising:

print receiving means;

a packet of printing elements each having a generally flat edge and an axis of rotation proximate said flat edge, said printing elements being generally coaxially disposed and mutually aligned adjacent the print receiving means so that the flat edge of each of the printing elements is generaly disposed toward the print receiving means, each printing element having a plurality of character faces circumferentially disposed relative to its axis of rotation;

means for axially translating the printing elements to place a selected printing element in a pre-selected pre-print position; and means for rotating the selected printing element to juxtapose a selected character face toward the print receiving means in print position for printing of said character face.

2. A system according to claim 1 wherein each printing element includes at least two series of radially spaced circumferentially disposed character faces and further comprising means for adjusting the distance between the mutual axis of the coaxially aligned printing elements and the print receiving means to place the series of character faces including said selected character face in position for printing.

3. A system according to claim 2 wherein said printing elements includes 3 radially spaced series of character faces.

4. A printing system according to claim 1 additionally comprising input means which includes N independently actuatable input elements; and wherein the packet of printing elements includes N printing elements, each printing element having N circumferentially disposed character faces, said axially translating means including means for translating the printing elements responsively to an actuation of an input element and said rotating means includes means for rotating the selected printing element responsively to another actuation of an input element.

5. A printing system according to claim 4 wherein said input means is a keyboard having N independently actuatable keys constituting said input elements.

6. A printing system according to claim 4 wherein N is about 50.

7. A printing system according to claim 1 wherein said printing elements are each generally semi-circular in form having a semicircular edge and a diametric edge comprising the flat edge, and are mutually aligned so that their diametric edges are generally disposed adjacent the print receiving means.

8. A printing system according to claim 7 wherein said printing elements are each in the form of a hub with a plurality of spokes extending therefrom, the character faces being disposed on the spokes.

9. A printing system according to claim 1 wherein said print receiving means includes a print receiving sheet and a horizontal platen which presents at least a portion of the sheet in a generally planar configuration for printing, and wherein the printing elements are coaxially aligned below said platen, their axis being aligned perpendicular to the plane of the portion of the sheet in a generally planar configuration for printing.

10. A printing system according to claim 1 in which the translating means comprises means for axially translating the packet of printing elements in unison to place a selected printing element in a preselected pre-print position.

11. A printing system comprising:

print-receiving means;

input means having a plurality of input elements;

a packet of printing elements, each printing element having a generally flat edge, an axis of rotation proximate said flat edge, and at least two radially spaced series of a plurality of character faces disposed circumferentially relative to the axis of rotation, said printing elements being generally coaxially disposed and mutually aligned adjacent the print receiving means so that their generally flat edges are disposed adjacent the print receiving means;

means for axially translating said packet of printing elements in response to actuation of an input element to place a selected printing element in pre-print position;

means for rotating the selected printing element in response to another actuation of an input element to juxtapose a selected character face toward the print receiving means in print position for printing of said character face; and means for adjusting the distance between the axis of the selected printing element and the print receiving means by discrete amounts corresponding to the radial distance between any two radially spaced series of character faces on the selected printing element, said adjusting means operating in response to actuation of an input element to place a selected series of character faces including said selected character face in position for printing.

12. A printing system according to claim 11 wherein each printing element includes at least 3 radially spaced series of character faces.

13. A printing system according to claim 11 wherein said means for adjusting the distance between the axis of the selected printing element and the print receiving means includes means for adjusting the position of the axis of all the printing elements in unison.

14. A printing system according to claim 11 wherein:

said print means includes N independently actuatable input elements and a shift element having M separately selectable positions;

said packet includes about N printing elements, each printing element having M radially spaced series of N circumferentially disposed character faces;

said means for axially translating the printing elements operates in response to actuation of an independently actuatable input element;

said means for rotating the selected printing element operates in response to another actuation of an independently actuatable input element; and said means for adjusting the distance between the axis of the selected printing element and the print-receiving means operates in response to actuation of a separately actuatable input element.

15. A printing system according to claim 14 wherein said input means is a keyboard having N independently actuatable keys constituting said independently actuatable input elements.

16. A printing system according to claim 15 further comprising at least one visual character array displaying characters in relating to the key actuating translation of a selected printing element including a selected character face to pre-print position, and also displaying the characters in relation to the key actuating rotation of said selected printing element to place said selected character face in print position.

17. A printing system according to claim 14 wherein N is about 50 and M is about 3.

18. A printing system according to claim 11 wherein said printing elements are each generally semi-circular in form having a semi-circular edge and a diametric edge comprising the flat edge, aligned with their diametric edges generally disposed adjacent said print receiving means.

19. A printing system according to claim 18 wherein said printing elements are each in the form of a hub with a plurality of spokes extending therefrom, the character faces of each radially spaced series being circumferentially disposed on the spokes.

20. A printing system according to claim 11 wherein said print receiving means includes a print receiving sheet and a horizontal cylindrical platen which presents at least a portion of the sheet in a generally planar configuration for printing and wherein said printing elements are coaxially aligned beneath said platen, their mutual axis being aligned perpendicular to the plane of the portion of the sheet in a generally planar configuration for printing.

21. A printing system for languages having a large number of characters to be printed, wherein said large number is generally equal to $N \times N \times M$, where M is an integer from about 2 to 6, and N is an integer from about 20 to 70, comprising:

print receiving means presenting at least a portion of a print receiving sheet in a generally planar position for printing;

a set of N generally planar parallel printing elements rotatable about a common axis normal to their planes, each printing element having $N \times M$ character faces circumferentially disposed in M radially spaced series about the axis of rotation of the printing element, said printing elements being generally coaxially aligned proximate said print receiving means;

a keyboard having at least N independently actuatable keyboard elements and shifting means having at least M positions;

means for adjusting the distance between the axis of the printing elements and that portion of the print receiving sheet in position for printing responsively to the position of the shifting means;

means for translating the printing elements in response to actuation of a keyboard element to place a selected printing element in a pre-selected pre-print position in a plane juxtaposed to that portion of the print receiving sheet in position for printing; and means for rotating the selected printing element in response to another actuation of a keyboard element to juxtapose a selected character face toward the print receiving sheet in print position.

22. A printing system according to claim 21 wherein N is about 50.

23. A printing system according to claim 21 wherein M is about 3.

24. A printing system according to claim 21 wherein:

said printing elements are generally semi-circular in form, having a generally semi-circular edge and a diametric edge, and are generally coaxially disposed and mutually aligned in a packet so that their diametric edges are generally disposed the print receiving means; and said means for translating a selected printing element comprises means for axially translating all of the printing elements in unison.

25. A printing system according to claim 24 wherein each printing element is in the form of a hub with about N spokes extending therefrom, the character faces being circumferentially disposed on the spokes.

26. A printing system according to claim 24 wherein said print receiving means includes a print receiving sheet and a horizontal cylindrical platen which presents at least a portion of the sheet in a generally planar configuration for printing, and wherein said printing elements are coaxially aligned beneath said platen, their axis being aligned perpendicular to the plane of the portion of the sheet in a generally planar configuration for printing.

27. A printing system comprising:

print receiving means presenting at least a portion of a print receiving sheet in a generally planar position for printing;

input means having a plurality of input elements;

a packet of generally semi-circular printing elements each having a diametric edge wherein said printing elements are coaxially disposed and mutually aligned adjacent said print-receiving means so that the diametric edges of the printing elements are disposed toward said print receiving means, each printing element being in the form of a hub having about N spokes extending therefrom;

means for axially translating the coaxially aligned printing elements in response to actuation of an input element to place a selected printing element in pre-print position in a plane juxtaposed to the plane of the portion of the sheet in position for printing;

means for rotating the selected printing element in pre-print position in response to another actuation of an input element to juxtapose a selected character face on a given spoke of said selected printing element toward said portion of the print receiving sheet in print position for printing of said character face.

28. A printing system according to claim 27 wherein said means for axially translating the printing elements operates by translating all of the printing elements in unison.

29. A printing system according to claim 27 wherein each printing element includes at least two radially spaced series of N character faces circumferentially disposed on said spokes and further comprising means for adjusting the distance between the axis of the selected printing element and the print receiving means in response to actuation of an input element to place the series of character faces including said selected character in position for printing.

30. A printing system according to claim 29 wherein said printing elements generally include 3 or 4 radially spaced series of character faces circumferentially disposed on said spokes.

31. A printing system according to claim 29 wherein said input means includes N independently actuatable input elements and wherein the packet of printing elements includes about N printing elements.

32. A printing system according to claim 31 wherein N is about 50.

33. A printing system according to claim 31 wherein said input means is a keyboard having N independently actuatable keys constituting said input elements.

34. A printing system according to claim 27 wherein said print receiving means includes a print receiving sheet and horizontal cylindrical platen which presents at least a portion of the sheet in a generally planar configuration for printing and wherein said printing elements are coaxially aligned beneath said platen, their mutual axis being aligned perpendicular to the plane of the portion of the sheet in a generally planar configuration for printing.

35. A system for printing languages having a large number of characters, said system comprising:

input means having independently actuatable input elements;

means for organizing the characters into an array having at least two dimensions, two dimensions of said array being approximately equal to but no greater than N;

printing means including a set of N rotatable printing elements, each of said printing elements having a generally flat edge, an axis of rotation proximate to said flat edge and N character faces circumferentially disposed about said axis of rotation, said printing elements being coaxially disposed and generally mutually aligned so that their flat edges are generally disposed in the same direction;

means for translating the printing elements in unison to place a selected printing element in pre-print position in response to actuation of an input element; and means for rotating the selected printing element to N discrete print position from its pre-print position in response to subsequent actuation of an input element for printing of a single desired character.

36. A system for printing languages according to claim 35 further comprising print receiving means and wherein said printing elements are generally semi-circular in form, having an arcuate edge and a diametric edge, with their diametric edges generally disposed toward the print receiving means.

37. A system for printing languages according to claim 36 wherein the printing elements are each in the form of a hub with about N spokes extending therefrom, and wherein the character faces are disposed on said spokes.

38. A system for printing languages according to claim 35 wherein N is about 50.

39. A system for printing languages according to claim 35 wherein said input means is a keyboard having N independently actuatable keys constituting said input elements.

40. A system for printing languages according to claim 35 wherein said printing elements include at least two radially spaced series of about N character faces, said input means includes separately actuatable input elements, and further comprising means for radially displacing all of the printing elements in unison in response to actuation of a separately actuatable input element to locate a selected series of character faces in position for printing.

41. A system for printing languages according to claim 40 wherein said printing elements each have about 3 radially spaced series of about N circumferentially disposed character faces.

42. A system for printing languages having a large number of characters, said system comprising:

keyboard means having N independently actuatable keyboard elements and shift means for production of M shift positions;

means for organizing the characters in a three-dimensional array, two dimensions of said array being equal to N, and the third dimension being equal to M;

a set of about N planar printing elements each having a generally flat edge, an axis of rotation proximate said flat edge and about $N \times M$ character faces disposed in N discrete circumferential positions and M discrete radial positions relative to said axis, said printing elements generally mutually aligned with their flat edges disposed in the same direction, each printing element being translatable to pre-print position, rotatable to N discrete positions in its pre-print position, and radially displaceable in M discrete steps;

means for presenting at least a portion of a print receiving sheet in a generally planar position for printing;

means for translating a selected printing element into pre-print position in a plane juxtaposed to the plane of the portion of the sheet in position for printing in response to actuation of an independently actuatable keyboard element;

means for rotating the selected printing element in pre-print position in response to subsequent actuation of an independently actuatable keyboard element to place a selected radial set of character faces in juxtaposition to said portion of the sheet in position for printing; and means for radially displacing the selected printing element in response to actuation of a shift means to place a selected character of the radial set in position for printing.

43. A system for printing languages according to claim 42 wherein N is about 50 and M is about 3.

44. A system for printing languages according to claim 42 wherein said printing elements are each in the form of a hub having about N spokes extending therefrom, wherein the character faces are disposed on the spokes.

45. A system for printing languages according to claim 42 wherein said print receiving means is in the form of a horizontal cylindrical platen having an axis and said printing elements are aligned beneath said platen with their mutual axis horizontal.

46. A printing system according to claim 1, 11, 21, 27, or 36 and wherein said character faces are in the form of solid raised figures adapted to print the characters upon impact of the character faces upon the print receiving means.

* * * * *